US011759798B2

(12) United States Patent
Lin et al.

(10) Patent No.: US 11,759,798 B2
(45) Date of Patent: Sep. 19, 2023

(54) HAND-HELD SHOWER HEAD

(71) Applicant: FUJIAN XIHE SANITARY WARE TECHNOLOGY CO., LTD., Fujian (CN)

(72) Inventors: Xiaofa Lin, Fujian (CN); Xiaoshan Lin, Fujian (CN); Jinchun Zhuang, Fujian (CN); Jianhui Gao, Fujian (CN); Huaran Liu, Fujian (CN); Xiaoqing Deng, Fujian (CN); Qiqiao Liu, Fujian (CN)

(73) Assignee: FUJIAN XIHE SANITARY WARE TECHNOLOGY CO., LTD., Fujian (CN)

( * ) Notice: Subject to any disclaimer, the term of this patent is extended or adjusted under 35 U.S.C. 154(b) by 191 days.

(21) Appl. No.: 17/235,942

(22) Filed: Apr. 21, 2021

(65) Prior Publication Data

US 2022/0280955 A1 Sep. 8, 2022

(30) Foreign Application Priority Data

Mar. 5, 2021 (CN) ..... 202110248461.0

(51) Int. Cl.
*B05B 1/16* (2006.01)
*B05B 1/18* (2006.01)

(52) U.S. Cl.
CPC ..... *B05B 1/1645* (2013.01); *B05B 1/185* (2013.01)

(58) Field of Classification Search
CPC ..... B05B 1/16; B05B 1/1627; B05B 1/1636; B05B 1/1645; B05B 1/18; B05B 1/185
See application file for complete search history.

(56) References Cited

U.S. PATENT DOCUMENTS

2021/0138488 A1* 5/2021 Lin ..... B05B 1/326

FOREIGN PATENT DOCUMENTS

CN 203220977 10/2013
CN 110694807 A * 1/2020 ..... B05B 1/16

* cited by examiner

*Primary Examiner* — Darren W Gorman
(74) *Attorney, Agent, or Firm* — JCIPRNET

(57) ABSTRACT

A hand-held shower head includes a fixing element, a rotating element and a first spring. The fixing element is provided with a water inlet channel and a first water outlet channel for flushing water. The rotating element is rotatably connected with the fixing element and is provided with a water passage and a second water outlet channel for spraying water. The first spring is disposed between the fixing element and the rotating element. When the rotating element rotates to a first position, the water passage communicates with the water inlet channel and the first water outlet channel, and the first spring is elastically deformed. When the rotating element is released from the first position, the first spring elastically recovers to drive the rotating element to rotate to a second position, and the second water outlet channel communicates with the water inlet channel.

9 Claims, 11 Drawing Sheets

HAND-HELD SHOWER HEAD

CROSS-REFERENCE TO RELATED APPLICATION

This application claims the priority benefit of Chinese application serial no. 202110248461.0, filed on Mar. 5, 2021. The entirety of the above-mentioned patent application is hereby incorporated by reference herein and made a part of this specification.

BACKGROUND

Technical Field

The disclosure relates to the field of water outlet devices, in particular to a hand-held shower head.

Description of Related Art

In the related art, shower heads are mainly used for gardening and showering. However, no matter whether the shower head is used for gardening or showering, a flushing method with a greater water flow rate and a longer spraying distance as well as a spraying method with a smaller water flow rate and a larger coverage area are in demand. In the shower room, the spraying method is mainly used for cleaning the human body due to the gentle water output, and the flushing method is mainly used for cleaning the shower room due to the flushing force of the water.

In order to combine the two water outlet methods mentioned above, the China utility model application no. 201320278350.5 published on Oct. 2, 2013 provides a hand-held shower head, which is designed with two water outlets perpendicular to each other for flushing and spraying respectively. The two water outlet modes can be switched by rotating the water outlet cover relative to the body. However, the above technical solution has three drawbacks. First, after switching to the flushing mode, if the user directly closes the valve which opens and closes for water to enter without switching the water outlet mode back to the spraying mode after cleaning the shower room, the next time when the shower head is used again, it is very likely to cause unnecessary splashes due to the large flushing force of the water, and which might even cause harm to the baby's body when showering for the baby. Secondly, when switching from the spraying mode to the flushing mode, if the user is not careful enough and makes the water outlet that flushes water face upward or the ceiling of the shower room, the water is likely to flush the electrical appliances on the wall or the ceiling of the shower room, which causes short circuit or damage to the lighting device and jeopardizes the user's safety. Thirdly, it takes a longer time to assemble the shower head described above to realize the rotatable connection between the body and the water outlet cover of the hand-held shower head in the above technical solution, and thus the labour cost is high.

SUMMARY

The following describes the concept of the subject in detail, and the concept is not intended to limit the scope of the claims.

In order to achieve the above purpose, the following technical solutions are adopted.

An embodiment of the disclosure provides a hand-held shower head, which includes a fixing element, a rotating element and a first spring. The fixing element is provided with a water inlet channel and a first water outlet channel for flushing water. The rotating element is rotatably connected to the fixing element and is provided with a water passage and a second water outlet channel for spraying water. The first spring is disposed between the fixing element and the rotating element. When the rotating element rotates to a first position, the water passage communicates with the water inlet channel and the first water outlet channel. When the rotating element is released from the first position, the first spring elastically recovers and drives the rotating element to rotate to a second position. At this time, the second water outlet channel communicates with the water inlet channel. Therefore, every time the hand-held shower head is used, it is possible to avoid the condition that the water comes out from the first water outlet channel.

BRIEF DESCRIPTION OF THE DRAWINGS

In order to explain the technical solutions of the embodiments more clearly, the following briefly describes the drawings that need to be adopted in the description of the embodiments.

DESCRIPTION OF THE EMBODIMENTS

In the claims and specification, unless otherwise specified, the terms "first", "second" or "third" are used to distinguish different objects, rather than to describe a specific order; the term "water outlet direction" refers to the outward direction of the corresponding water outlet along its axis; the term "circumferential direction" refers to the circumferential direction with the rotation axis as the axis; the term "water outlet channel" refers to a water channel with a water outlet; the term "water outlet" refers to the waterway port where water flows outward from the hand-held shower head; the term "non-rotatably" means that two objects cannot rotate relative to each other; and the term "position-limiting cooperation" means that two objects cannot move relative to each other in a specific direction.

The technical solutions in the embodiments of the disclosure will be clearly and thoroughly described below in conjunction with the drawings in the embodiments of the disclosure.

Figure 1:
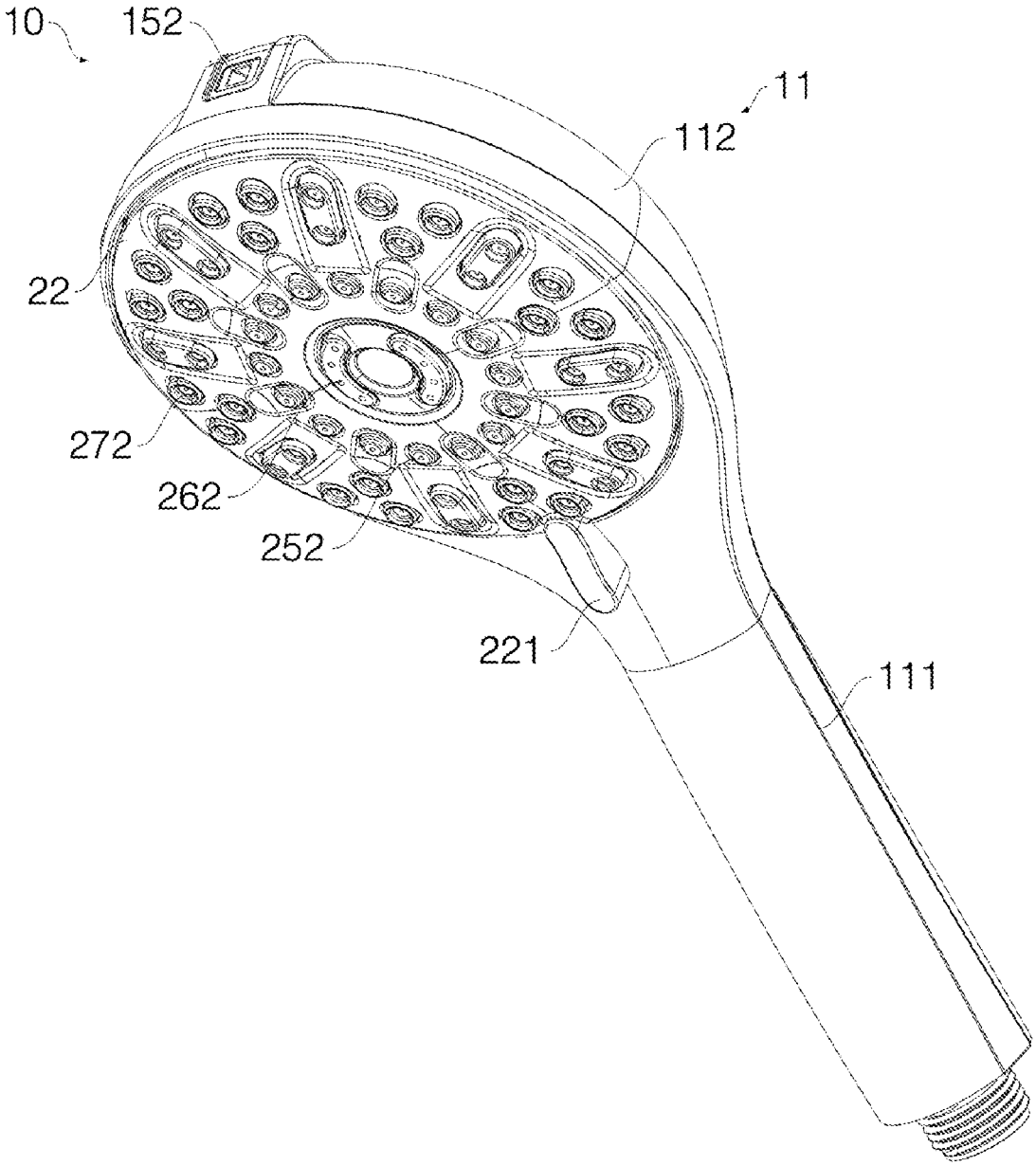
FIG. 1 is a perspective view of a hand-held shower head in an embodiment.
Figure 2:
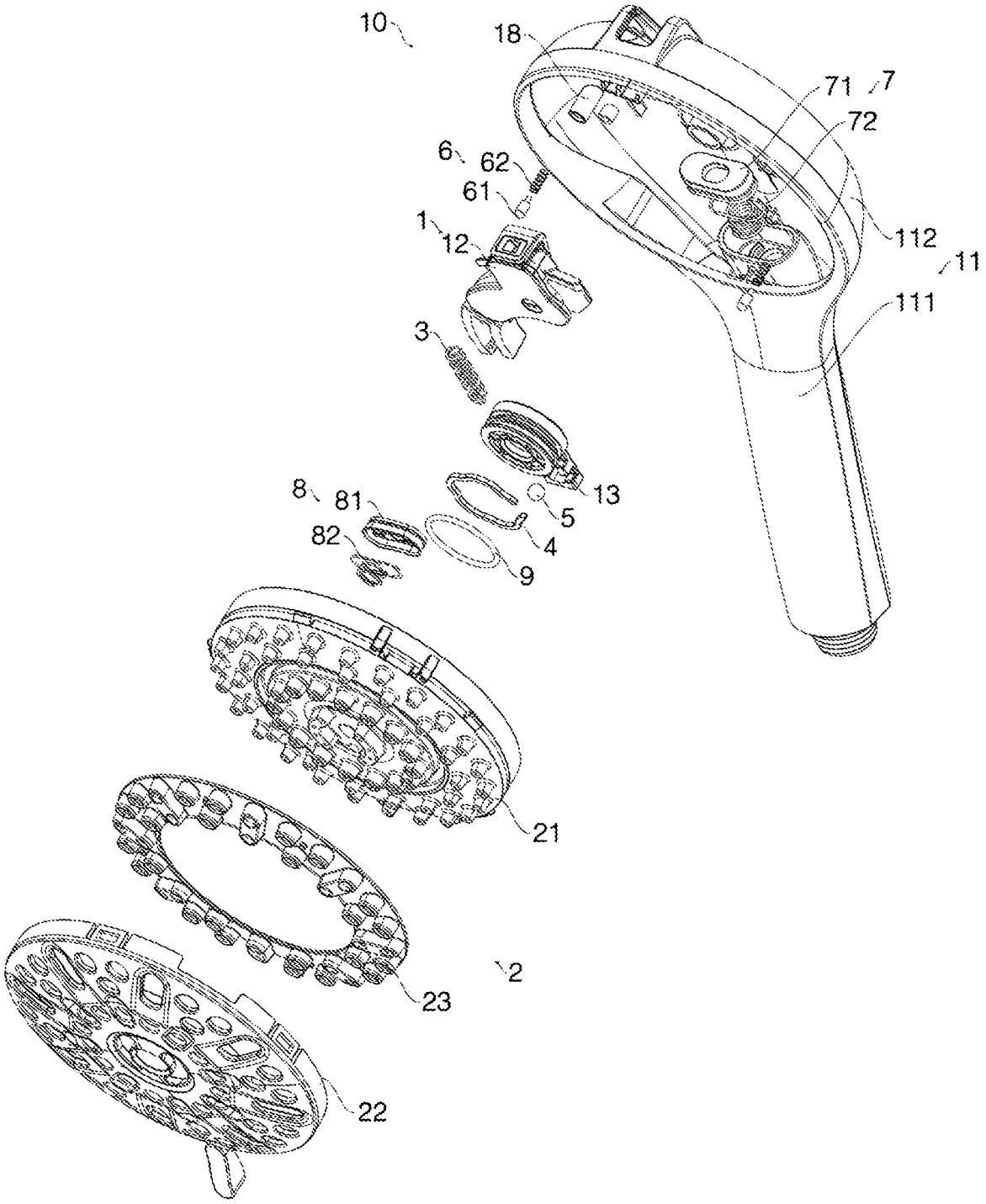
FIG. 2 is a perspective exploded view of the hand-held shower head in the embodiment.
Figure 3:
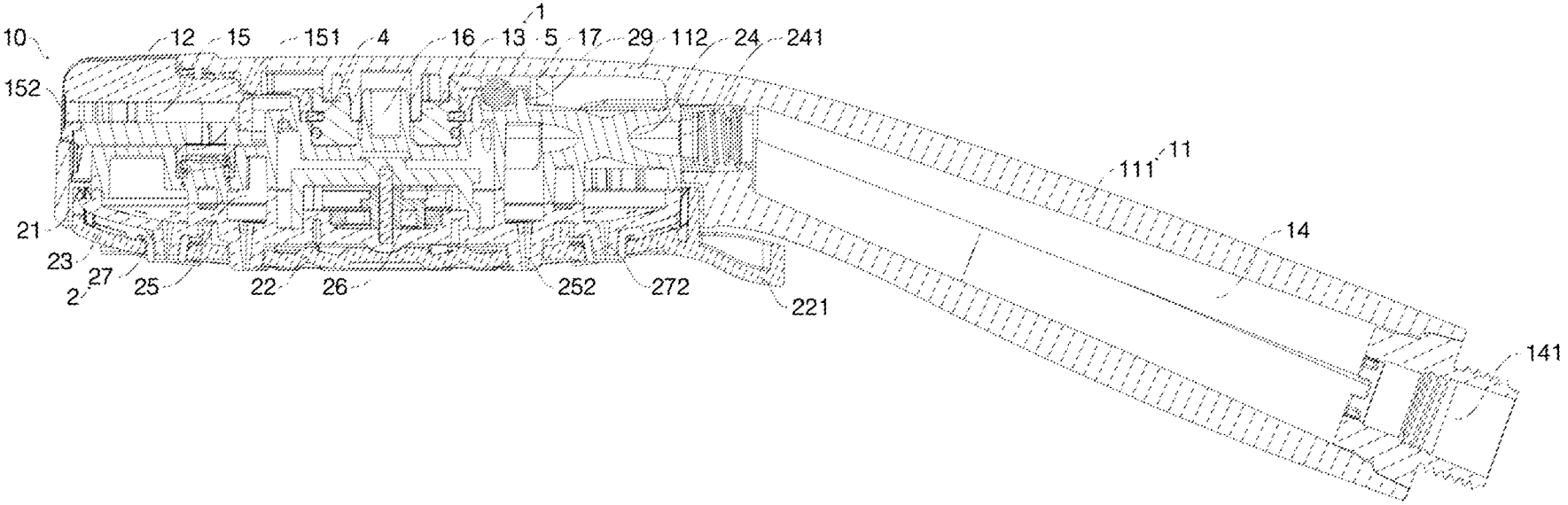
FIG. 3 is a cross-sectional view of the hand-held shower head in the embodiment.

FIG. 1, FIG. 2 and FIG. 3 show the overall structure of the hand-held shower head 10. In this embodiment, the hand-held shower head 10 includes a fixing element 1, a rotating element 2 that rotates with the fixing element 1 around a rotation axis, a first spring 3, a circlip 4, a blocking member 5, a positioning element 6, a first sealing element 7, a second sealing element 8 and a sealing ring 9.

As shown in FIG. 2 and FIG. 3, the fixing element 1 includes a body 11, a water outlet base 12 and a fixing base 13. The body 11 is provided with a handle 111 and a top cover 112 which are integrally connected with each other. The handle 111 is provided with a water inlet channel 14. As shown in FIG. 3, one end of the water inlet channel 14 away from the top cover 112 is provided with a water inlet 141, and the other end of the water inlet channel 14 is provided with a first sealing cavity for accommodating the first sealing element 7. A portion of the top cover 112 away from the handle 111 is provided with a notch, and the notch is configured for the water outlet base 12 to extend thereout. A lower surface of the top cover 112 extending downward is provided with a positioning base 18, and one end of the positioning base 18 facing downward is provided with a positioning base opening. The positioning base 18 is configured for accommodating the positioning element 6.

Figure 4:
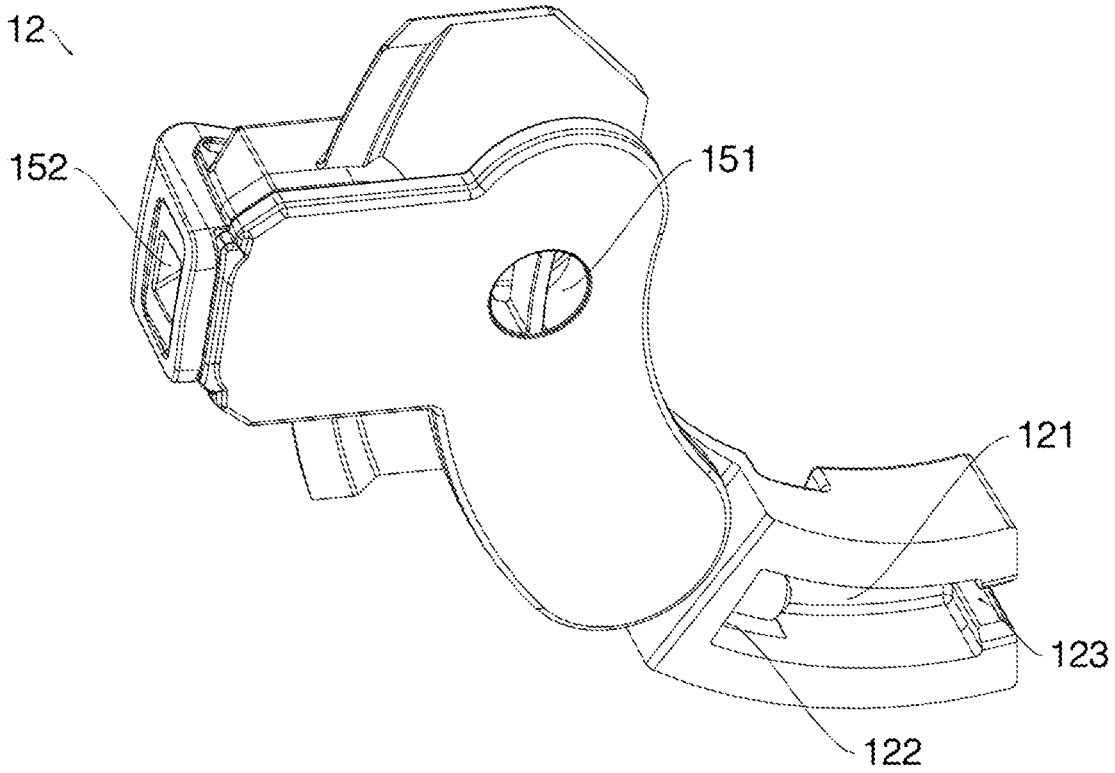
FIG. 4 is a perspective view of a water outlet base in the embodiment.

As shown in FIG. 3 and FIG. 4, the water outlet base 12 is fixedly connected to the top cover 112 and extends out of the notch on the top cover 112. Specifically, in this embodiment, the water outlet base 12 and the top cover 112 are engaged and connected to each other. The water outlet base 12 is provided with a first water outlet channel 15 and an accommodating recess 121 extending in the circumferential direction. The first water outlet channel 15 is provided with a first water passage port 151 and a first water outlet 152. The first water passage port 151 is opened on a bottom surface of the water outlet base 12 away from the top cover 112, and the first water outlet 152 is opened on the water outlet base 12 away from the handle 111. A water outlet direction of the first water outlet 152 is perpendicular to the rotation axis, and the water outlet direction of the first water outlet 152 is located on the same plane as the axis of the handle 111. Therefore, it is convenient for the user to hold the hand-held shower head 10 when using the first water outlet 152 to clean the shower room. Of course, in other embodiments, the water outlet direction of the first water outlet 152 may not be perpendicular to a rotation axis. In this embodiment, a water passing area of the first water outlet 152 is smaller than a water passing area of the water inlet 141, so the first water outlet 152 has the function of flushing. The accommodating recess 121 is configured for accommodating the first spring 3, one end of the accommodating recess 121 close to the first water outlet 152 forms a first abutting surface 122, and the other end of the accommodating recess 121 is provided with an accommodating recess opening 123.

Figure 5:
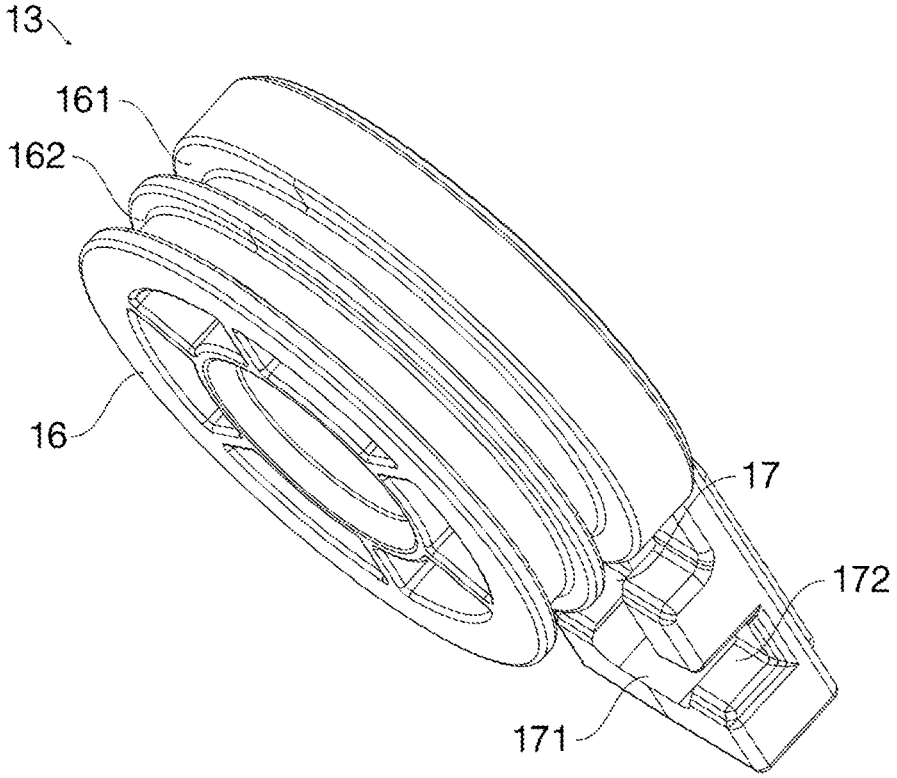
FIG. 5 is a perspective view of a fixing base in the embodiment.

As shown in FIG. 3 and FIG. 5, the fixing base 13 is fixedly connected to the top cover 112. Specifically, in this embodiment, the fixing base 13 and the top cover 112 are welded. The fixing base 13 is provided with a protrusion shaft 16 and a sliding slot 17. The protrusion shaft 16 takes the rotation axis as the axis and extends in a direction away from the top cover 112. A side wall of the protrusion shaft 16 is provided with a first annular recess 161 and a sealing ring recess 162. The sealing ring recess 162 is located below the first annular recess 161. The sliding slot 17 is located on the fixing base 13 away from the first water outlet 152. An extending direction of the sliding slot 17 is the same as the water outlet direction of the first water outlet 152. One end of the sliding slot 17 away from the first water outlet 152 is provided with a position-limiting wall 171. Therefore, when the water outlet direction of the first water outlet 152 is upward relative to a horizontal plane, the sliding slot 17 is not parallel to the horizontal plane and the position-limiting wall 171 is located at the lower end of the two ends of the sliding slot 17. A side wall of the sliding slot 17 is provided with a sliding slot opening 172, and the sliding slot opening 172 is close to the position-limiting wall 171.

Figure 7:
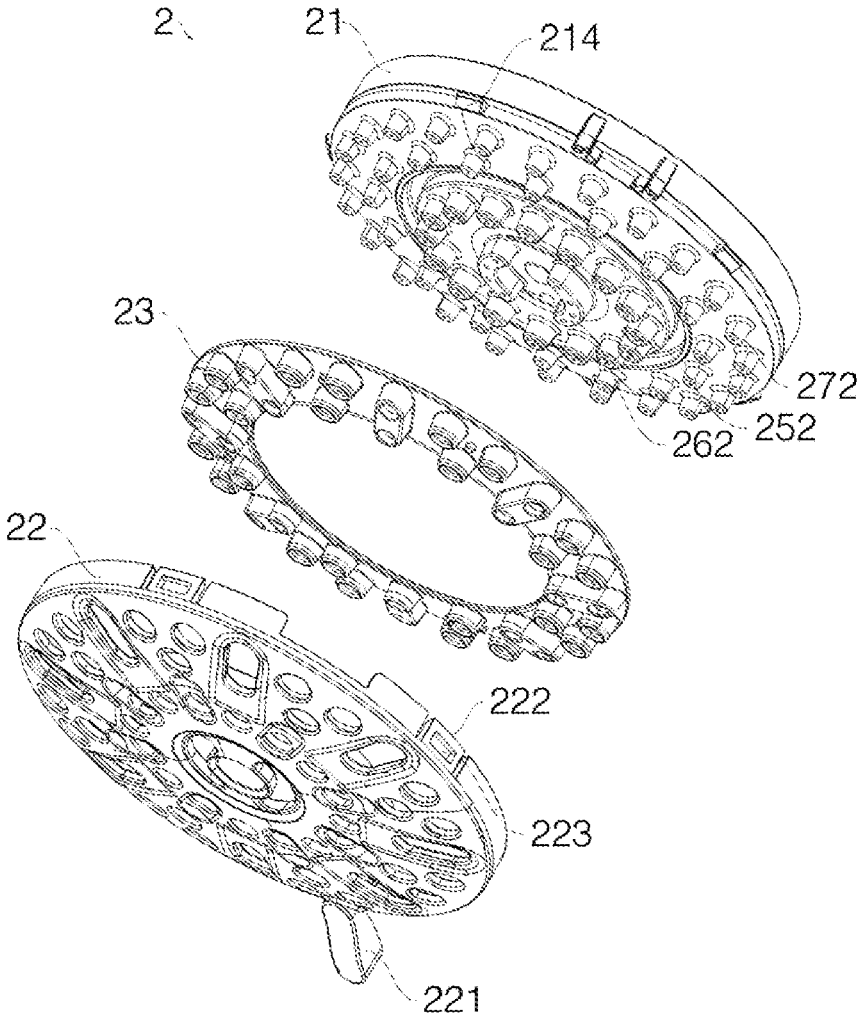
FIG. 7 is a perspective exploded view of a rotating element in the embodiment.
Figure 8:
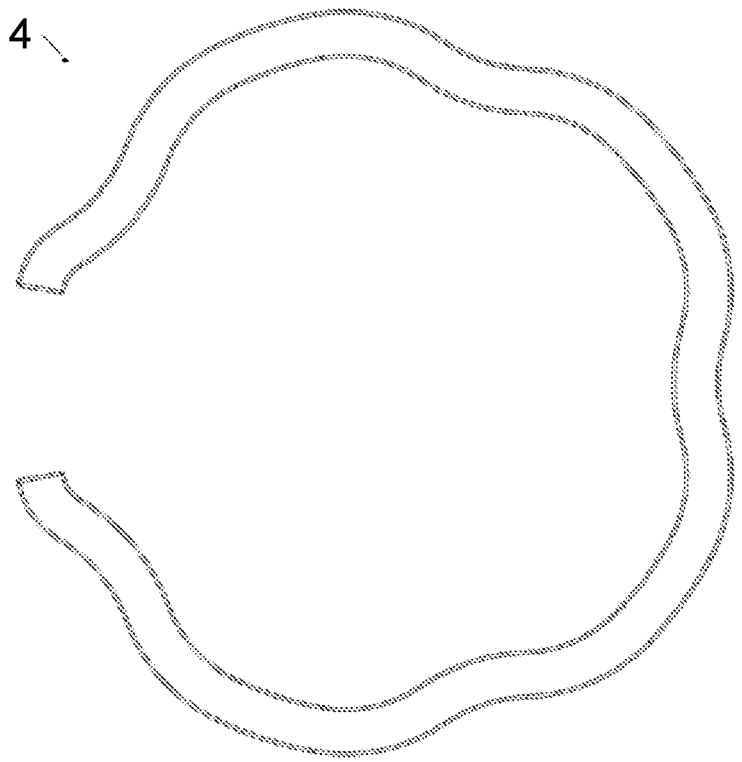
FIG. 8 is a top view of a circlip in the embodiment.

As shown in FIG. 3 and FIG. 7, the rotating element 2 includes a water diversion base 21, a water outlet cover 22 and a water outlet sleeve 23.

As shown in FIG. 3, FIG. 6, FIG. 7, FIG. 9, and FIG. 10, the water diversion base 21 and the fixing base 13 are rotatably connected around the rotation axis. The water diversion base 21 is provided with a water passage 24, a second water outlet channel 25, a third water outlet channel 26, and a fourth water outlet channel 27. The water passage 24 is provided with a second water passage port 241 and a third water passage port 242. The second water outlet channel 25 is provided with a fourth water passage port 251 and a plurality of second water outlets 252, and the third water outlet channel 26 is provided with a fifth water passage port 261 and a plurality of third water outlets 262. The fourth water outlet channel 27 is provided with a sixth water passage port 271 and a plurality of fourth water outlets 272. Specifically, the second water passage port 241, the fourth water passage port 251, the fifth water passage port 261, and the sixth water passage port 271 are all arranged on the outer circular surface of the water diversion base 21 and arranged along the circumferential direction, so as to facilitate sealed communication with the water inlet channel 14. The third water passage port 242 is disposed on an end surface of the water diversion base 21 facing the water outlet base 12, and a second sealing cavity is formed for accommodating the second sealing element 8. A water outlet direction of each of the second water outlets 252, a water outlet direction of each of the third water outlets 262, and a water outlet direction of each of the fourth water outlets 272 are all parallel to the rotation axis, and therefore are all perpendicular to the water outlet direction of the first water outlet 152. Certainly, the water outlet direction of each of the second water outlets 252, the water outlet direction of each of the third water outlets 262, and the water outlet direction of each of the fourth water outlets 272 intersect with or are the same as the water outlet direction of the first water outlet 152, which can also achieve the purpose of this disclosure. Specifically, all the fourth water outlets 272 are located at an outer periphery of all the second water outlets 252, and all the second water outlets 252 are located at the periphery of all the third water outlets 262. Each of the second water outlets 252, each of the third water outlets 262, and each of the fourth water outlets 272 are configured to realize the function of spraying water. The water diversion base 21 is also provided with a shaft sleeve 213 extending toward the fixing base 13. The shaft sleeve 213 is provided with a bore 28 for the protrusion shaft 16 to insert therein. An insertion end of the bore 28 is provided with a chamfer 281 that presses the circlip 4 to deform the circlip 4. The wall of the bore 28 is provided with a second annular recess 282. The water diversion base 21 realizes the rotational connection through the cooperation of the bore 28 and the protrusion shaft 16. Of course, in other embodiments, the bore 28 can also be disposed on the fixing element 1, and the protrusion shaft 16 can also be correspondingly disposed on the water diversion base 21, which does not affect the connection relationship between the two. The water diversion base 21 is also provided with a protrusion 211 extending toward the water outlet base 12. The protrusion 211 is configured to be inserted into the accommodating recess 121 through the accommodating recess opening 123. A surface of the protrusion 211 facing the first abutting surface 122 forms a second abutting surface 212. The second abutting surface 212 is opposite to the first abutting surface 122 along the circumferential direction. The water diversion base 21 is further provided with an insert block 29 which is configured to be inserted into the sliding slot 17 through the sliding slot opening 172. An upper surface of the water diversion base 21 facing the top cover 112 is provided with three positioning indents 215 along the circumferential direction. In this embodiment, the outer circular surface of the water diversion base 21 is also provided with a plurality of clamping blocks 214.

As shown in FIG. 7, in this embodiment, the water outlet sleeve 23 has a ring shape and is only configured to sleeve outside of each of the fourth water outlets 272.

As shown in FIG. 7, in this example, the water outlet cover 22 is provided with a radially extending operating handle 221 and a plurality of engaging bases 222. Each of the engaging bases 222 is provided with an engaging slot 223 which is used to cooperate with the clamping block 214, so that the water outlet cover 22 and the water diversion base 21 are non-rotatably engaged with each other, and the water outlet sleeve 23 is clamped between the water outlet cover 22 and the water diversion base 21. Therefore, it is easy and convenient to assemble the water diversion base 21, and the water outlet sleeve 23 and the water outlet cover 22 of the rotating element 2.

Figure 10:
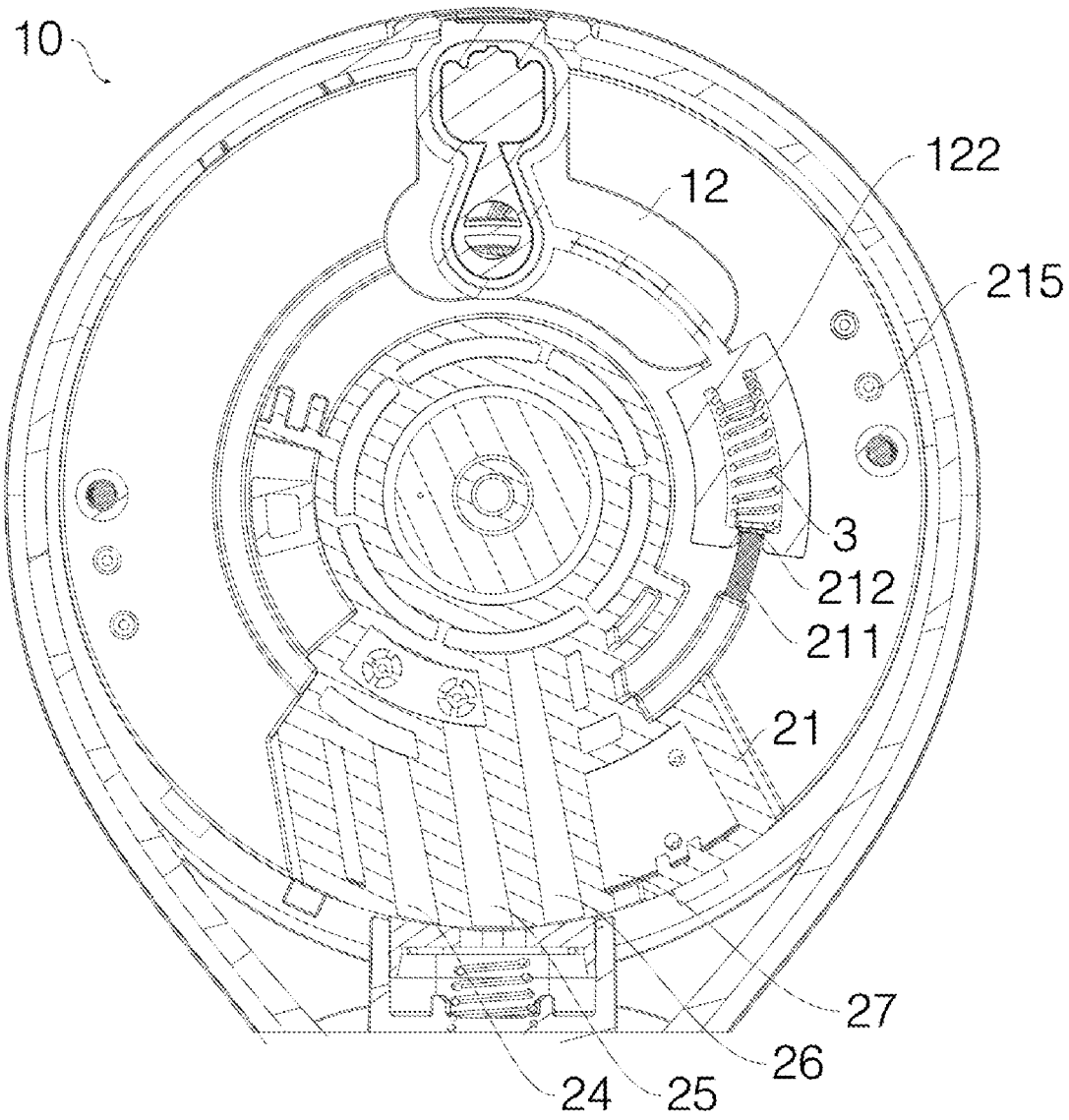
FIG. 10 is a schematic view of the state of the first spring when the rotating element is at the second position in the embodiment.
Figure 12:
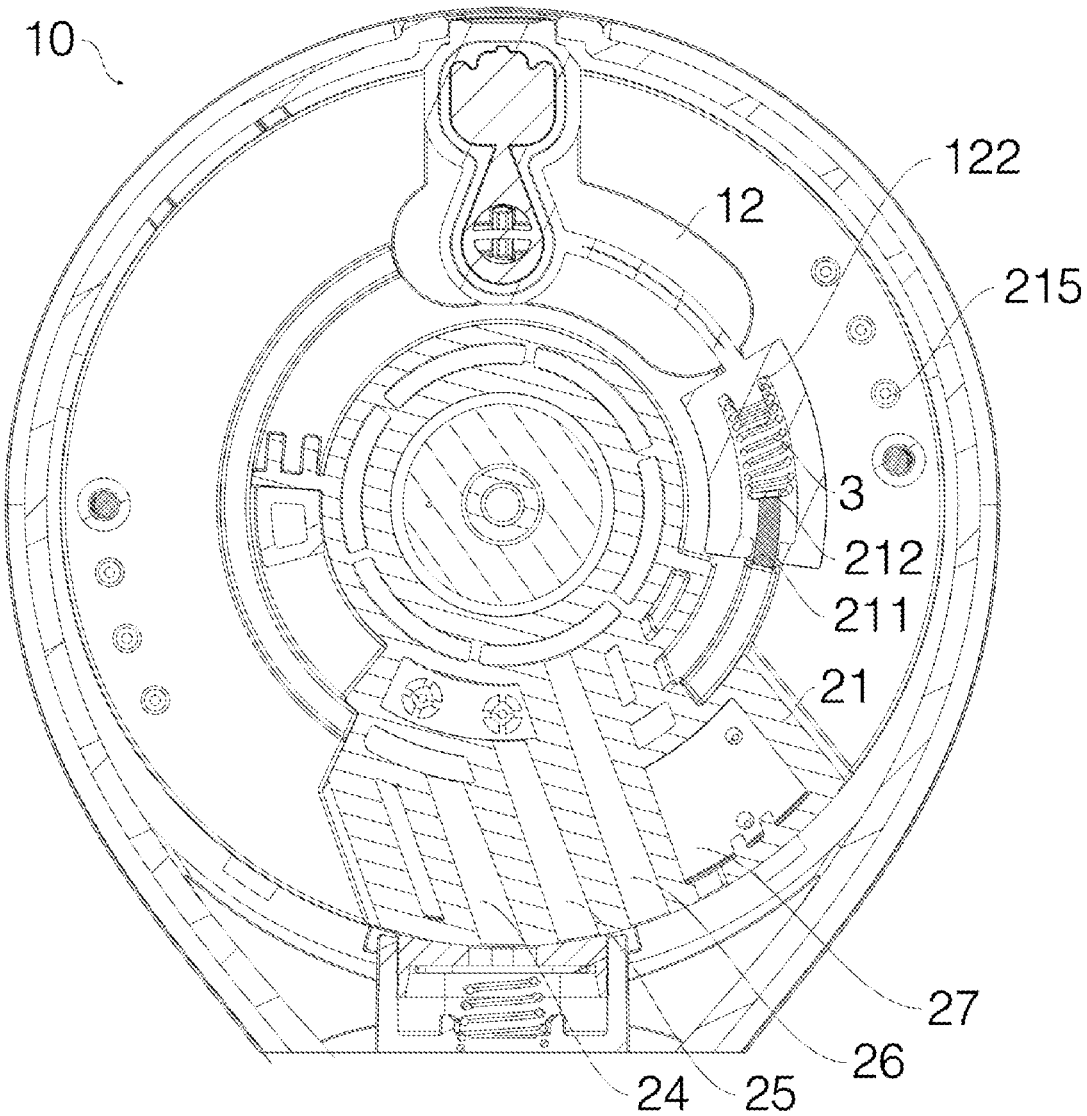
FIG. 12 is a schematic view of the state of the first spring when the rotating element is at the first position in the embodiment.

As shown in FIG. 10 and FIG. 12, the first spring 3 is disposed in the accommodating recess 121 and is always located between the first abutting surface 122 and the second abutting surface 212. Since the first spring 3 is disposed in the accommodating recess 121, even if the protrusion 211 is separated from the accommodating recess 121, the state of the first spring 3 is reliable.

As shown in FIG. 3, FIG. 5, FIG. 6 and FIG. 8, the circlip 4 is in the shape of a ring with an opening, and is wavy after being expanded in the circumferential direction. The circlip 4 is disposed in the first annular recess 161 and extends into the second annular recess 282, so that the rotating element 2 and the fixing element 1 are in position-limiting cooperation along the rotation axis direction. The shape of the circlip 4 in this embodiment enables the circlip 4 to receive force more uniformly in the circumferential direction during the deformation process, and the deformation can easily take place.

As shown in FIG. 2, FIG. 3, FIG. 9 and FIG. 11, the blocking member 5 is driven by gravity to roll or slide in the sliding slot 17. In this embodiment, the blocking member 5 is a rolling ball that rolls in the sliding slot 17. Only when the blocking member 5 is far away from the position-limiting wall 171, the insert block 29 is allowed to be inserted into the sliding slot 17. When the blocking member 5 rests on the position-limiting wall 171, the insert block 29 cannot be inserted into the sliding slot 17. In other embodiments, the blocking member 5 may also be a slider sliding in the sliding slot 17.

As shown in FIG. 2, the positioning element 6 is placed in the positioning base 18, and the positioning element 6 includes a positioning pin 61 and a second spring 62. One end of the second spring 62 presses against the top cover 112, and the other end of the second spring 62 presses against the positioning pin 61, so that the positioning pin 61 protrudes out of the opening of the positioning base.

As shown in FIG. 2, the first sealing element 7 is disposed in the first sealing cavity, and the first sealing element 7 includes a first cup 71 and a third spring 72. One end of the third spring 72 presses against the handle 111, and the other end of the third spring 72 presses against the first cup 71 to hold the first cup 71 on the outer circular surface of the water diversion base 21, so as to realize the sealed communication between the water inlet channel 14 and the second water passage port 241, the fourth water passage port 251, the fifth water passage port 261 or the sixth water passage port 271.

Figure 6:
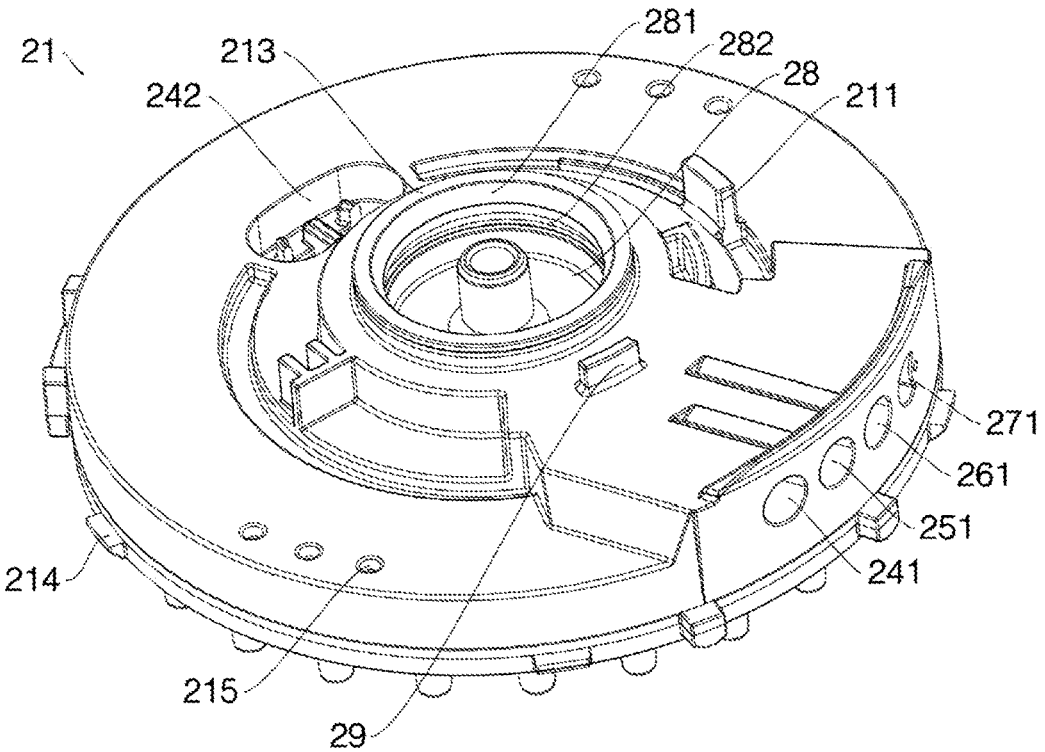
FIG. 6 is a perspective view of a water diversion base in the embodiment.

As shown in FIG. 2 and FIG. 6, the second sealing element 8 is disposed in the second sealing cavity, and the second sealing element 8 includes a second cup 81 and a fourth spring 82. One end of the fourth spring 82 presses against the water diversion base 21, and the other end of the fourth spring 82 presses against the second cup 81 to hold the second cup 81 on the lower surface of the water outlet base 12, so as to realize the sealed communication between the water passage 24 and the first water passage port 151.

As shown in FIG. 2 and FIG. 5, the sealing ring 9 is placed in the sealing ring recess 162 to achieve the seal between the protrusion shaft 16 and the bore 28.

For the hand-held shower head 10 in this embodiment, the fixing element 1 and the rotating element 2 are assembled first, and then the circlip 4 is placed in the first annular recess 161. The blocking member 5 is placed in the sliding slot 17, and the positioning element 6 is placed in the positioning base 18. The first sealing element 7 is placed in the first sealing cavity, the second sealing element 8 is placed in the second sealing cavity, and the sealing ring 9 is placed in the sealing ring recess 162. Finally, the protrusion shaft 16 is inserted into the bore 28, and the chamfer 281 at the insertion end of the bore 28 presses the circlip 4 to elastically deform the circlip 4 and squeeze into the bore 28 until it falls into the second annular recess 282 to recover elastically, so that the rotating element 2 and the fixing element 1 are rotatably connected with each other in an axis-limiting manner. At this point, the hand-held shower head 10 is successfully assembled. Therefore, in this embodiment, only one insertion operation is required to establish the rotational connection relationship between the rotating element 2 that cooperates with the fixing element 1 in the axis-limiting manner, so that the assembly of the fixing element 1 and the rotating element 2 is easier.

Figure 11:
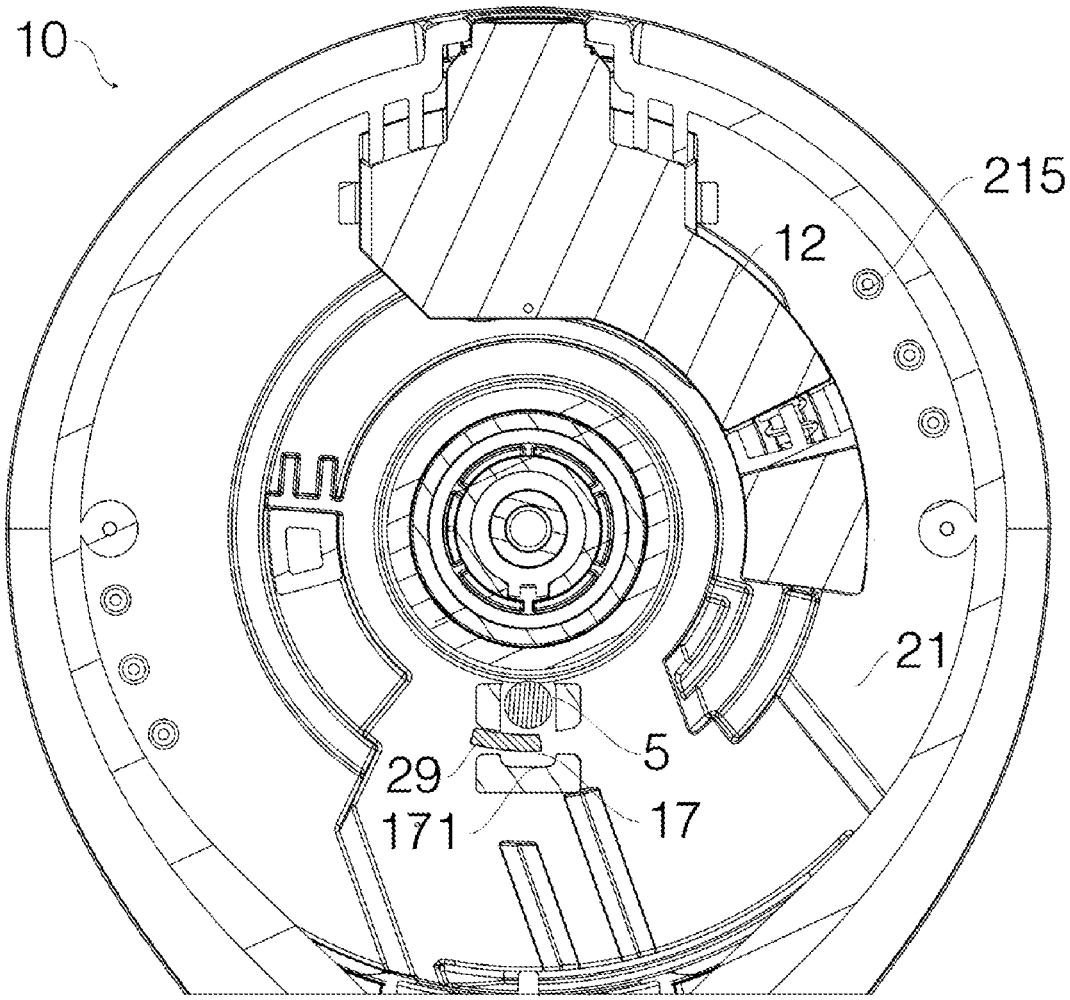
FIG. 11 is a schematic view of a relationship between the insert block and the sliding slot when the rotating element is at a first position in the embodiment.

After the hand-held shower head 10 is assembled, as shown in FIG. 11 and FIG. 12, when the rotating element 2 rotates to the first position relative to the fixing element 1, the water passage 24 communicates with the water inlet channel 14 and the first water outlet channel 15 to flush water. Specifically, the second water passage port 241 is in sealed communication with the water inlet channel 14 through the first sealing element 7. The third water passage port 242 is in sealed communication with the first water passage port 151 through the second sealing element 8, and the first water outlet 152 discharges water. At this time, the insert block 29 is inserted into the sliding slot 17 through the sliding slot opening 172, and the protrusion 211 is inserted into the accommodating recess 121 through the accommodating recess opening 123, so that the first spring 3 is compressed and elastically deformed. The positioning pin 61 is held on the upper surface of the water diversion base 21, and is not in the three positioning indents 215, which facilitates the first spring 3 to drive the rotating element 2 to rotate to the second position. At this time, the extending direction of the operating handle 221 is the same as the axial direction of the handle 111, so that the user can use the operating handle 221 to apply force and to overcome the elastic force of the first spring 3, thereby keeping the rotating element 2 at the first position.

Figure 9:
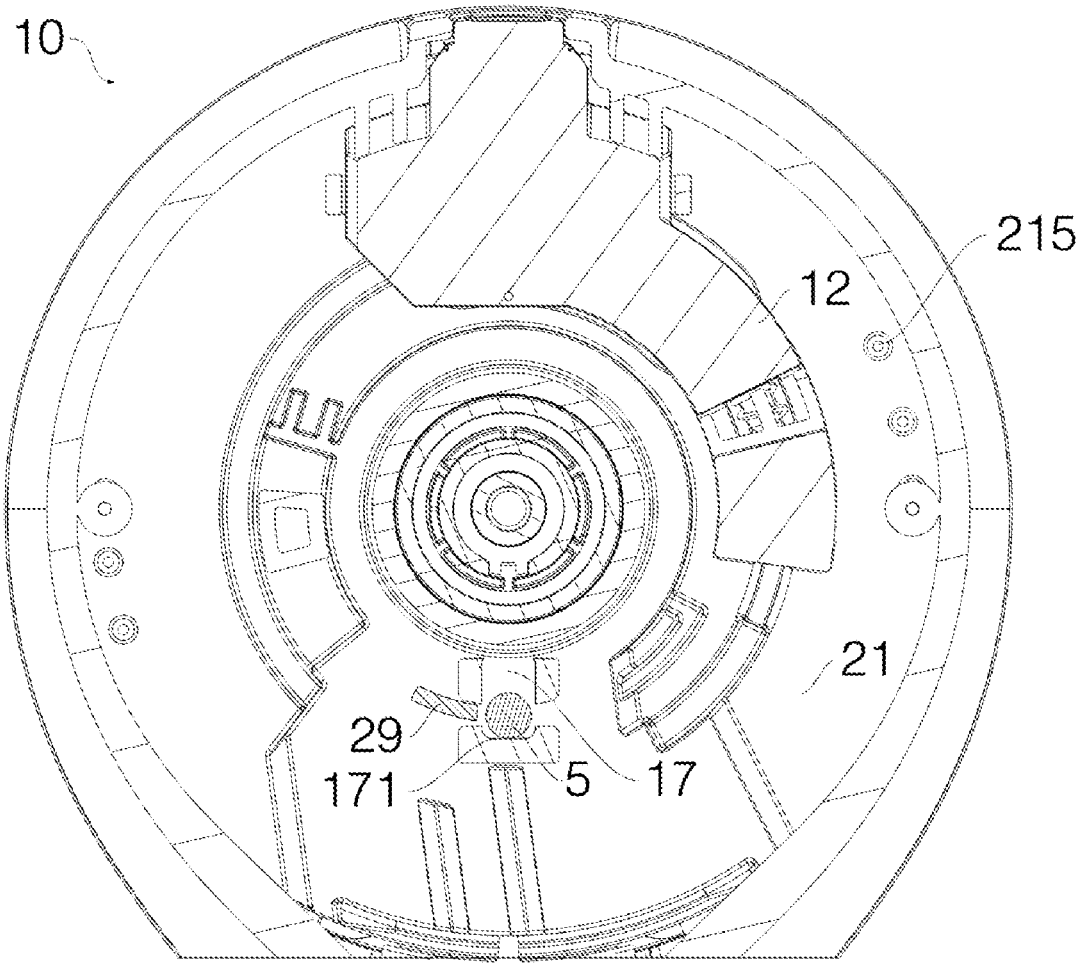
FIG. 9 is a schematic view of a relationship between an insert block and a sliding slot when the rotating element is at a second position in the embodiment.

As shown in FIG. 9 and FIG. 10, when the rotating element 2 is at the first position, the user releases the operating handle 221, and the first spring 3 elastically recovers and drives the rotating element 2 to rotate to the second position relative to the fixing element 1. Under the circumstances, the second water outlet channel 25 is in communication with the water inlet channel 14. Specifically, the fourth water passage port 251 is in sealed communication with the water inlet channel 14, and each of the second water outlet ports 252 discharges water. Under the circumstances, the protrusion 211 is pushed out of the accommodating recess 121 by the first spring 3, the insert block 29 is not inserted into the sliding slot 17 through the sliding slot opening 172, and the positioning pin 61 extends into the positioning indent 215 corresponding to the second position. When the user does not apply any force, the hand-held shower head 10 must switch from the water flushing mode of the first water outlet 152 to the water spraying mode of the second water outlet 252, so that it is possible to avoid the flushing mode every time in the beginning of using the hand-held shower head 10.

The user continues to drive the operating handle 221 to rotate the rotating element 2 to the third position. Under the circumstances, the third water outlet channel 26 is in communication with the water inlet channel 14. Specifically, the fifth water passage port 261 and the water inlet channel 14 are in sealed communication through the first sealing element 7, and water is discharged from each of the third water outlets 262. Under the circumstances, the protrusion 211 is away from the accommodating recess 121, the insert block 29 is away from the sliding slot 17, and the positioning pin 61 extends into the positioning indent 215 corresponding to the third position.

The user continues to drive the operating handle 221 to rotate the rotating element 2 to the fourth position. Under the circumstances, the fourth water outlet channel 27 is in communication with the water inlet channel 14. Specifically, the sixth water passage port 271 and the water inlet channel 14 are in sealed communication through the first sealing element 7, and water is discharged from each of the fourth water outlets 272. Under the circumstances, the protrusion 211 is farther away from the accommodating recess 121, the insert block 29 is farther away from the sliding slot 17, and the positioning pin 61 extends into the positioning indent 215 corresponding to the fourth position.

When the rotating element 2 rotates between the second position, the third position, and the fourth position, since none of the protrusions 211 is inserted into the accommodating recess 121, the first spring 3 is not deformed.

The positioning pin 61 extends into a corresponding one of the three positioning indents 215 when the rotating element 2 is rotated to the second, third, and fourth positions, so that the user can have a clear sense of switching when switching between the three water spraying modes.

As shown in FIG. 9, when the rotating element 2 rotates from the second position to the first position, if the water outlet direction of the first water outlet 152 is upward relative to the horizontal plane, the blocking member 5 rolls to abut against the position-limiting wall 171. Under the circumstances, the blocking member 5 does not allow the insert block 29 to enter the sliding slot 17. Therefore, the rotating element 2 cannot be rotated to the first position, and the first water outlet 152 cannot discharge water. Therefore, the hand-held shower head 10 of this embodiment is safer. Only when the water outlet direction of the first water outlet 152 is parallel to the horizontal plane or downward relative to the horizontal plane, the blocking member 5 is far away from the position-limiting wall 171. Under the circumstances, the blocking member 5 allows the insert block 29 to insert into the sliding slot 17 through the sliding slot opening 172, so that the rotating element 2 can be rotated to the first position, and water is discharged from the first water outlet 152.

The foregoing descriptions in the specification and embodiments serve to explain the protection scope of the disclosure, but do not constitute a limitation on the protection scope of the disclosure.

What is claimed is:

1. A hand-held shower head, comprising:

a fixing element, provided with a water inlet channel, a first water outlet channel and a first abutting surface, wherein the water inlet channel is provided with a water inlet, the first water outlet channel is provided with a first water outlet, and a water passing area of the first water outlet is smaller than a water passing area of the water inlet;

a rotating element, rotatably connected with the fixing element around a rotation axis and provided with a water passage, a second water outlet channel, and a second abutting surface, wherein the second water outlet channel is provided with a plurality of second water outlets, the second abutting surface is opposite to the first abutting surface in a circumferential direction; when the rotating element rotates to a first position, the water passage is in communication with the water inlet channel and the first water outlet channel; when the rotating element rotates to a second position, the second water outlet channel is in communication with the water inlet channel;

a first spring, arranged between the first abutting surface and the second abutting surface, configured to be elastically deformed when the rotating element is rotated from the second position to the first position, and elastically recovered when the rotating element is released from the first position to drive the rotating element to rotate to the second position; and a blocking member, wherein the fixing element is further provided with a sliding slot having a position-limiting wall, when a water outlet direction of the first water outlet faces upward relative to a horizontal plane, the sliding slot is not parallel to the horizontal plane and the position-limiting wall is located at a lower end of both ends of the sliding slot;

the rotating element is further provided with an insert block, the insert block is configured to be inserted into the sliding slot when the rotating element is rotated to the first position; and the blocking member is driven by gravity to roll or slide in the sliding slot, and the insert block is allowed to be inserted into the sliding slot only when the blocking member is far from the position-limiting wall.

2. The hand-held shower head according to claim 1, wherein the rotation axis is perpendicular to the water outlet direction of the first water outlet and parallel to a water outlet direction of each of the second water outlets.

3. The hand-held shower head according to claim 2, further comprising a circlip, wherein one of the fixing element and the rotating element is provided with a protrusion shaft with the rotation axis as an axis, and a first annular recess is provided on a side wall of the protrusion shaft;

the other one of the fixing element and the rotating element is provided with a bore for insertion of the protrusion shaft, and an insertion end of the bore is provided with a chamfer for pressing the circlip to deform the circlip, a wall of the bore is provided with a second annular recess;

the circlip is disposed in the first annular recess and extends into the second annular recess, such that the rotating element and the fixing element are in position-limiting cooperation in a direction along the rotation axis.

4. The hand-held shower head according to claim 3, wherein the circlip is in a shape of a ring with an opening, and is wavy after being expanded in the circumferential direction.

5. The hand-held shower head according to claim 1, wherein an extending direction of the sliding slot is the same as the water outlet direction of the first water outlet, a side wall of the sliding slot is provided with a sliding slot opening, and the sliding slot opening is adapted to be passed through by the insert block so as to insert into the sliding slot.

6. The hand-held shower head according to claim 5, wherein the fixing element comprises a body, a water outlet base and a fixing base, the body is provided with a handle and a top cover;

the water inlet channel is disposed on the handle, the top cover is fixedly connected to the handle at a position away from the water inlet;

the water outlet base is fixedly connected to the top cover and located at a position away from the handle, the first water outlet channel is disposed at the water outlet base, the first water outlet channel is further provided with a first water passage port, the first water passage port is opened on a bottom surface of the water outlet base away from the top cover, the water outlet base is provided with an accommodating recess extending in the circumferential direction for accommodating the first spring, one end of the accommodating recess forms the first abutting surface, and the other end of the accommodating recess is provided with an accommodating recess opening;

the fixing base is fixedly connected to the top cover, the protrusion shaft and the sliding slot are disposed on the fixing base, and the protrusion shaft extends in a direction away from the top cover.

7. The hand-held shower head according to claim 6, wherein the rotating element comprises a water diversion base, a water outlet cover and a water outlet sleeve, the water passage and the second water outlet channel are both disposed on the water diversion base, the water passage is provided with a second water passage port and a third water passage port, the second water outlet channel is provided with a fourth water passage port, the third water passage port is disposed on an end surface of the water diversion base facing the water outlet base, and is in sealed communication with the first water passage port when the rotating element rotates to the first position;

the second water passage port and the fourth water passage port are all arranged on an outer circular surface of the water diversion base and arranged in the circumferential direction, the second water passage port is in sealed communication with the water inlet channel when the rotating element rotates to the first position, and the fourth water passage port is in sealed communication with the water inlet channel when the rotating element rotates to the second position;

the water diversion base is provided with a protrusion extending toward the water outlet base, the protrusion is adapted to be inserted into the accommodating recess through the accommodating recess opening, and a surface of the protrusion facing the first abutting surface forms the second abutting surface; the water diversion base is further provided with a shaft sleeve extending toward the fixing base, the bore is disposed on the shaft sleeve;

the insert block is disposed on the water diversion base; the water outlet cover is provided with a radially extending operating handle; the water outlet cover and the water diversion base are non-rotatably engaged with each other, and clamp the water outlet sleeve therebetween.

8. The hand-held shower head according to claim 7, wherein the water diversion base is further provided with a third water outlet channel and a fourth water outlet channel, the third water outlet channel is provided with a fifth water passage port and a plurality of third water outlets, a water outlet direction of the third water outlets is parallel to a water outlet direction of the second water outlets;

the fourth water outlet channel is provided with a sixth water passage port and a plurality of fourth water outlets, a water outlet direction of the fourth water outlets is parallel to the water outlet direction of the second water outlets; the sixth water passage port and the fifth water passage port are all arranged on the outer circular surface of the water diversion base, and are arranged along the circumferential direction with the fourth water passage port and the second water passage port;

when the rotating element rotates to a third position, the fifth water passage port and the water inlet channel are in sealed communication; when the rotating element rotates to a fourth position, the sixth water passage port is in sealed communication with the water inlet channel;

during rotation of the rotating element among the second position, the third position, and the fourth position, the first spring is not deformed.

9. The hand-held shower head according to claim 8, further comprising a positioning element, wherein the positioning element comprises a positioning pin and a second spring, the top cover is provided with a positioning base for accommodating the positioning element, one end of the positioning base facing the water diversion base is provided with a positioning base opening, one end of the second spring presses against the top cover, and the other end of the second spring presses against the positioning pin, such that the positioning pin protrudes out of the positioning base opening; a surface of the water diversion base facing the top cover is provided with three positioning indents along the circumferential direction; the positioning pin is inserted into a corresponding one of the three positioning indents when the rotating element rotates to the second position, the third position, and the fourth position respectively.

* * * * *